US008858303B2

(12) United States Patent
Salomon

(10) Patent No.: US 8,858,303 B2
(45) Date of Patent: Oct. 14, 2014

(54) PROTECTIVE COVER FOR A HANDHELD POWER TOOL

(75) Inventor: Gunnar Salomon, Hamburg (DE)

(73) Assignee: Makita Corporation, Aichi (JP)

( * ) Notice: Subject to any disclaimer, the term of this patent is extended or adjusted under 35 U.S.C. 154(b) by 142 days.

(21) Appl. No.: 13/483,263

(22) Filed: May 30, 2012

(65) Prior Publication Data

US 2012/0312121 A1 Dec. 13, 2012

(30) Foreign Application Priority Data

Jun. 8, 2011 (DE) ..... 20 2011 050 394 U

(51) Int. Cl.
*B24B 55/04* (2006.01)

(52) U.S. Cl.
USPC ..... 451/451; 451/359; 451/450; 451/455; 125/13.01

(58) Field of Classification Search
USPC ..... 451/342, 344, 352, 359, 449, 450, 451, 451/452, 453, 455; 125/13.01
See application file for complete search history.

(56) References Cited

U.S. PATENT DOCUMENTS

| | | | | |
|---|---|---|---|---|
| 3,793,784 | A | 2/1974 | Jetzt | |
| 3,896,783 | A * | 7/1975 | Manning | 125/13.01 |
| 4,929,130 | A * | 5/1990 | Diebolt et al. | 409/136 |
| 5,826,478 | A * | 10/1998 | Zerrer | 83/169 |
| 7,520,799 | B2 * | 4/2009 | Wedel et al. | 451/450 |
| 7,713,111 | B2 * | 5/2010 | Layher et al. | 451/450 |
| 8,033,896 | B2 * | 10/2011 | Amend et al. | 451/454 |
| 2004/0042908 | A1 * | 3/2004 | Donnerdal | 417/229 |
| 2005/0034715 | A1 * | 2/2005 | Terpstra | 125/13.01 |
| 2006/0068690 | A1 | 3/2006 | Koschel et al. | |
| 2006/0123638 | A1 * | 6/2006 | Wedel et al. | 30/346.58 |
| 2006/0128289 | A1 * | 6/2006 | Wedel et al. | 451/449 |

FOREIGN PATENT DOCUMENTS

| | | |
|---|---|---|
| CN | 201863126 | 6/2011 |
| DE | 7028588 | 12/1970 |
| DE | 195 45 416 | 6/1997 |
| DE | 10 2007 032 6 | 1/2009 |
| FR | 2755632 | 5/1998 |

OTHER PUBLICATIONS

Search report from Germany, mail date is Mar. 12, 2012.
Search report from United Kingdom, mail date is Sep. 7, 2012.

* cited by examiner

*Primary Examiner* — Eileen P. Morgan
(74) *Attorney, Agent, or Firm* — Greenblum & Bernstein, P.L.C.

(57) ABSTRACT

A protective cover for a handheld power tool, with a tool that is at least partially surrounded by the protective cover, is formed of at least a first wall element and a second wall element, which in order to form a tool space are connected to each other in a parallel-spaced arrangement. The first wall element has a first circumferential section and the second wall element has a second circumferential section. The circumferential sections overlap each other and form a circumferential wall of the protective cover, with at least one opening which is provided in the outer-lying second circumferential section and under which the inner-lying first circumferential section extends.

10 Claims, 5 Drawing Sheets

PROTECTIVE COVER FOR A HANDHELD POWER TOOL

The present invention relates to a protective cover for a handheld power tool with a tools which is at least partially surrounded by the protective cover, whereby the protective cover is formed at least of a first wall element and a second wall element, which in order to form a tool space are connected to each other in a parallel-spaced arrangement.

PRIOR ART

DE 195 45 416 A1 shows a protective cover for a handheld power tool, which is in the form of a cutting grinder. The power tool has a tool, which is at least partially surrounded by a protective cover and the protective cover comprises a first wall element and a second wall element, which to create a tool space are connected to each other in a parallel-spaced arrangement. The tool is held rotatably in the tool space and the tool is a cutting disk.

Depending on the design of the power tool it may be necessary to arrange functional elements on the protective cover. As an example a functional element is shown in the form of a water supply device, which is arranged on the protective cover and used to spray water into the tool space in order, for example, to carry out the cutting process or grinding cutting process with the addition of water.

Disadvantageously the attachment of the functional element is cumbersome and costly, and the in the area of the joint of the two wall elements the protective cover has a joint seam which can represent a weak point of the protective cover. For example, the protective cover protects the operator if the tool of the power tool breaks. Flying fragments of the tool must be reliably held back by the protective cover and said joint between the wall elements can constitute a weak point in protecting the operator.

From DE 10 2007 032 672 A1 a protective cover for a tool of a handheld power tool is known, on which a functional element in the form of a water supply device is arranged for supplying water to the tool. The water supply device is made of a number of individual components, and the protective cover must be elaborately designed to allow the functional element to be attached.

DESCRIPTION OF THE INVENTION Aim, Solution, Advantages

It is therefore the aim of the present invention to create a protective cover for a handheld power tool which overcomes the drawbacks of the above prior art and provides a protective cover which with increased security allows an improved arranged of the functional elements on the protective cover.

This task is achieved on the basis of a protective cover for a handheld power tool in accordance with the introductory section of claim 1 in connection with the characterising features. Advantageous further developments of the invention are set out in the dependent claims.

The invention includes the technical teaching that the first wall element has a first circumferential section and the second wall element a second circumferential section, whereby the circumferential sections overlap each other and form a circumferential wall of the protective cover, whereby in the outer-lying second circumferential section at least one opening is provided, under which the inner-lying first circumferential section extends.

The invention there beneficially utilises the opportunity of creating wall elements provided with circumferential section, whereby the wall elements can be arranged with regard to each other in such a way that the circumferential sections overlap. This initially achieves the advantage of a radial double wall so that through the double wall the circumferential wall of the protective cover if formed. This achieves increased security of the protective cover, whereby also in the outer-lying second circumferential section a hole is provided, under which the inner-lying circumferential section extends. A functional element can now be arranged in the opening, whereby in the case of several functional elements to be provided on the protective cover a corresponding number of openings can be provided in the outer-lying second circumferential section. As the inner-lying first circumferential section extends under the opening, the protective effect against the tool is also retained in the area of the opening for arranging the functional element. In addition to protecting the operator against breakage of the tool, sparks or other accelerated particles released through the tool engaging in a workpiece, can also be secularly held back in the tool space in the area of the opening.

The protective cover can thus be advantageously designed to accommodate at least one functional element, whereby the functional element can have a projection which can be inserted into the opening. The functional element can, for example, have a hand grip for using the protective cover and/or a U-shaped element of a supply device for supplying a fluid medium to the tool, for example for supplying water. The functional element can also be designed as an integrated element which allows the supply of water and at the same time can be used as an operating element. The projection can be formed on the functional element and can, more particularly, have the same cross-section geometry as the opening in the protective cover. In this way the projection can be matched to the opening and the projection can securely engage in the opening essentially without play.

Advantageously the wall elements are made of a flat material by means of a punching and bending process, whereby at least one of the wall elements as a projecting lug into which the functional element can engage by means of at least one locking hook. The functional element, more particularly the U-shaped element of the supply device, can be applied to the protective cover from one joint direction. If the functional element is applied to the protective cover from the joint direction, by applying the functional element from the joint direction the projection on the functional element can enter the opening. At the same time or subsequently the locking hook formed on the functional element can engage in the projecting lug in the wall element. Preferably the functional element has two locking hooks and is in the shape of a U. The locking hooks are arranged at the ends of the shanks of the U-shaped element, and when the functional element is arranged on the protective cover the U-shaped element surrounds the protective cover. On each side of the protective cover, i.e. in each of the wall elements, a projecting lug can be provided, and when the functional element is arranged on the protective cover the projection can be inserted into the opening in the circumferential wall and the locking hooks on functional element can laterally clip into the lugs of the wall elements. This advantageously creates a secure, mechanically resilient arrangement of the functional element on the protective cover, without further connection elements being necessary. Consequently a protective element can be simply arranged on the protective cover without having to provide additional connection means.

Additionally or alternatively the wall elements can have at least one threaded hole into which a screw element can be screwed. The screw element can for example be a shaft screw with a screw head. Alternatively to the locking hooks on the functional element, one and preferably two holes can be provided on the functional element through which the screw elements can be passed and screwed into the relevant threaded hole in the protective cover.

In accordance with another advantageous further development of the protective cover according to the invention, for arranging a functional element, which can be in the form of a U-shaped element of a supply device for supplying water to the tool, at least one hole can be provided in the wall elements through which a spray nozzle arranged on the U-shaped element can be inserted or which aligns with the spray nozzle on the U-shaped element in order to supply the fluid medium, more particularly the water, through the hole to the tool. The spray nozzles can be attached on the U-shaped element on the inside in the shanks of the U-shaped element and if the U-shaped element is mounted on the wall elements of the protective cover the shanks of the U-shaped element adjoin the wall elements. If the spray nozzles are in alignment with the holes in the wall elements, and if the U-shaped element is supplied with the fluid medium, the fluid medium can be supplied directly to the tool through the spray nozzles. The positioning of the holes in the wall elements and the spray nozzles in the U-shaped element can be coordinated so that the spray nozzles align with the holes when the locking hooks are engaged in the holes of the wall elements and if at the same time the projection is inserted into the opening. In addition, on the inside on the shank of the U-shaped element in the region of the spray nozzles an annular seal can be provided, which seals the spray nozzles against the outside of the wall elements to prevent the fluid medium emerging between the U-shaped element and the outside of the wall elements.

The wall elements can be connected to each other by bonded connection or by means of connection elements more particularly rivet connections. The wall elements are connected via the circumferential sections, so that the first circumferential section is connected to the second circumferential section either by means of a bonded connection or by means of connection elements. More particularly rivet connections can be envisaged which extend radially through the protective cover and connect the first circumferential section to the second circumferential section. More particularly several rivet connections can be provided evenly distributed over the extent of the circumferential section.

The opening can form a rectangular, more particularly, quadratic cut-out in the circumferential section of the wall element or the opening can form a round cut-out, whereby, in particular, the projection on the functional element is matched to the shape of the opening. A rectangular, or quadratic, opening prevents twisting of the functional element, particularly if the projection is also matched to the shape of the opening. If the opening is round, a hole can be provided in the circumferential section next to the opening into which a pin arranged on the functional element can engage.

The edge of the opening in the circumferential section of the wall element can be radially bent up outwards in order to increase the height of the edge above the inner-lying circumferential section of the first wall element.

As a result a protective cover is created which is designed so that at least one functional element can be held in a self-retaining manner on the protective cover without any fastening means. Thus, between the protective cover and the functional element only a catch means is provided whereby locking hooks are applied to the functional element which engage in projecting lugs on the protective cover. In addition there is at least one opening in the protective cover into which a projection on the functional element can engage. If two locking hooks are provided which engage in corresponding lugs, and if a projection is provided on the functional element which engages in an opening in the protective cover, three-point holding of the functional element, more particularly a U-shaped element, is brought about. If the U-shaped element is also designed as an operating element for the manual operation of the protective cover and if greater mechanical forces are transmitted between the operating element and the protective cover, large force components can be transferred via the projection and the opening from the U-shaped element into the protective cover, and the engagement of the locking hooks in the lugs primarily serves to keep the projection positioned in the opening of the protective cover.

The aim of the present invention is also achieved through a handheld power tool with a tool and a protective cover, which at least partially surrounds the tool, whereby the protective cover comprises at least a first wall element and a second wall element, which are connected to each other to form a tool space, whereby the first wall element has a first circumferential section and the second wall element a second circumferential section and whereby the circumferential sections overlap each other and form a circumferential wall of the protective cover, whereby in the outer-lying second circumferential section there is at least one opening, under which the inner-lying first circumferential section extends.

BRIEF DESCRIPTION OF THE DRAWINGS

Further measures improving the invention are set out in more detail below together with the description of a preferred example of embodiment of the invention with the aid of the figures. Purely schematically.

PREFERRED FORM OF EMBODIMENT OF THE INVENTION

Figure 1:
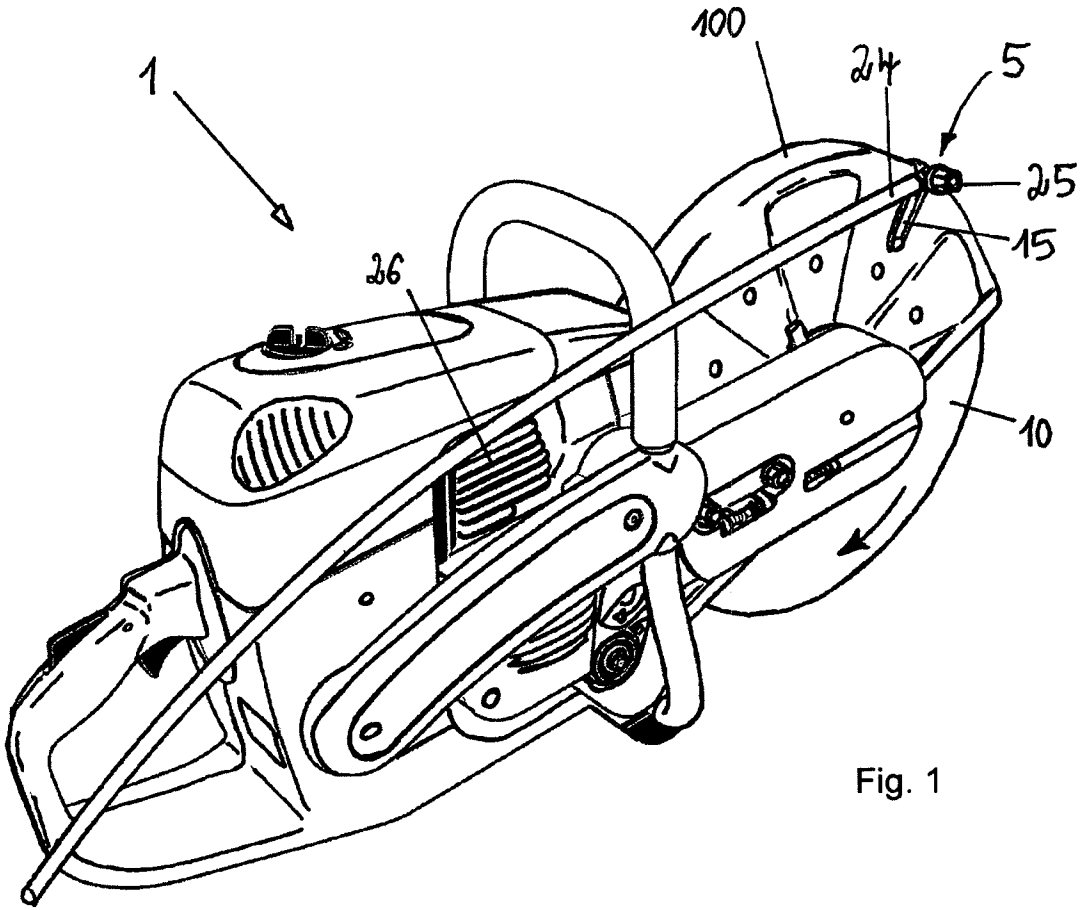
FIG. 1 shows a perspective view of a power tool with a tool and a protective cover, on which a supply device for supplying water to the tool is arranged.

FIG. 1 shows a perspective view of a handheld power tool 1, in the form of a cutting grinder for example and comprising a combustion motor 26, with which the tool 10 forming the cutting disk, can be driven rotatably in the direction indicated by the arrow. The power tool 1 comprises a protective cover 100, which surrounds the upper part of the tool 10. The protective cover 100 form a safety and protection device for the user of the power tool 1 and is made of metal sheets, which are created through stamping/bending from a flat metallic material.

Arranged on the protective cover 100 is a supply device 5 for supplying a fluid medium, for example for supplying water, to the tool 10. The supply device 5 comprises a U-shaped element 15, which constitutes a functional element 15 in accordance with the present invention that can be arranged on the protective cover 100. Provided on the U-shaped element 15 is a regulating valve 25 for regulating the quantity of water flowing to the tool 10. The fluid medium is supplied to the supply device 5 via a pipeline 24, with the fluid medium passing through the pipeline 24 at an overpressure. The fluid medium can be water, but, for example, the fluid medium can also be a coolant-lubricant emulsion. In accordance with the invention the functional element designed as a U-shaped element 15 of a supply device is arranged in a simple manner on the protective cover 100 as set out in more detail in the following figures.

Figure 2B:
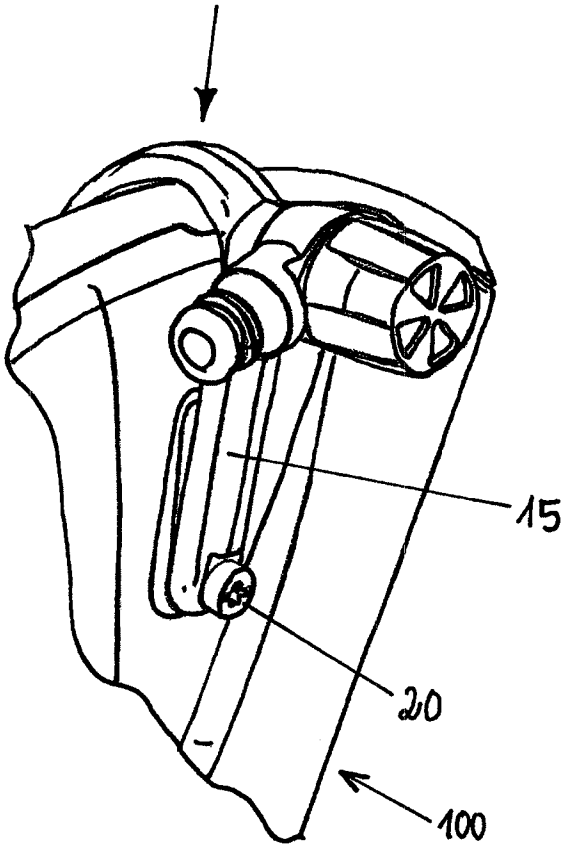
FIG. 2*b* shows the example of embodiment in FIG. 2*a* for arranging a U-shaped element on the protective cover, whereby the U-shaped element is attached to the protective cover with screw elements, FIG. 3*a* show a cross-section of the arrangement of the U-shaped element and the protective cover in accordance with FIG. 2*a*.
Figure 2A:
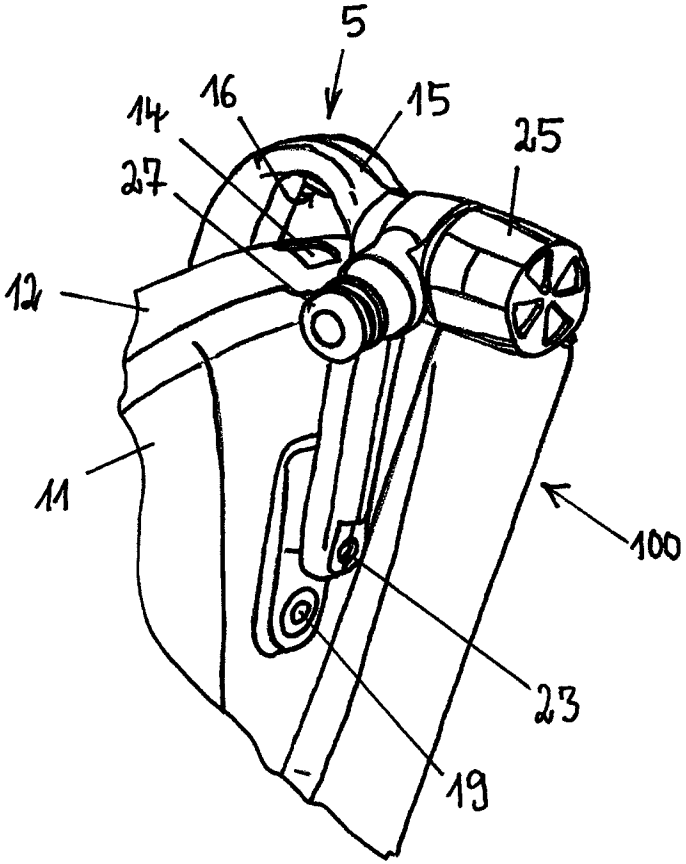
FIG. 2*a* shows an arrangement of a functional element on the protective cover, whereby the functional element is designed as a U-shaped element and is arranged in a non-engaging manner on the protective cover be.

FIG. 2*a* shows a section of the protective cover 100, in which the functional element 15 is arranged. The functional element 15 is in the form of a U-shaped element 15 of a supply device 5 which serves to supply water to the tool 10 of the power tool 1. Not shown is the pipeline 24 for supplying the water which can be connected to the coupling element 27 whereby the coupling element is moveably arranged on the U-shaped element 15. The U-shaped element 15 is made of a plastic material in a single or multiple step injection moulding process. In addition the supply device 5 has a regulating valve 25 that can be manually operated and with which the quantity of water flowing to the tool 10 can be adjusted.

The U-shaped element 15 has two shanks and thus forms a U shape. In this way the U-shaped element 15 can be placed on the protective cover 100, with one shank on each side of the protective cover 100.

The protective cover 100 is formed of a first wall element 11 and a second wall element 12 and the wall elements 11, 12 are connected to each other in a parallel-spaced arrangement. In wall element 12 there is an opening 14 in which a projection 16 applied to the inside of the U-shaped element 15 can engage. Through the shown elevated arrangement of the U-shaped element 15 overt the protective cover 100 is can be seen that the projection 16 can engage in the opening 14 in a precisely fitting manner when the U-shaped element 15 is finally placed on the protective cover 100. At the same time holes 23 in the ends of the shanks of the U-shaped element 15 can align with threaded holes 19 in the wall elements 11 and 12 into which screw elements 20 can be screwed as shown in FIG. 2*b*.

FIG. 2*b* shows the final arrangement of the U-shaped element 15 on the protective cover 100. The U-shaped element 15 is screwed laterally onto the protective cover 100 with screw element 20. At the same time the projection 16 engages in the opening 14 (not shown) in the circumferential wall of protective cover 100. The joint direction of the U-shaped element 15 is indicated by an arrow and through the arrangement of the U-shaped element 15 in accordance with the invention is mechanically highly resilient, so that, for example, operating forces can be transmitted via the U-shaped element 15 into the protective cover 100.

Figure 3B:
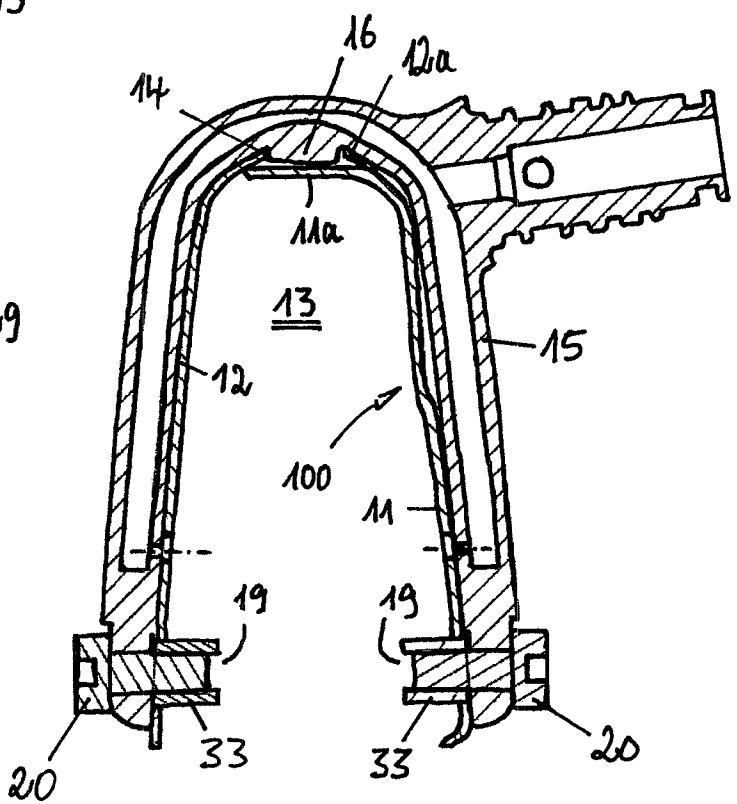
FIG. 3*b* shows a cross-section of a U-shaped element in an engaged arrangement on the protective cover in accordance with FIG. 2*b*.
Figure 3A:
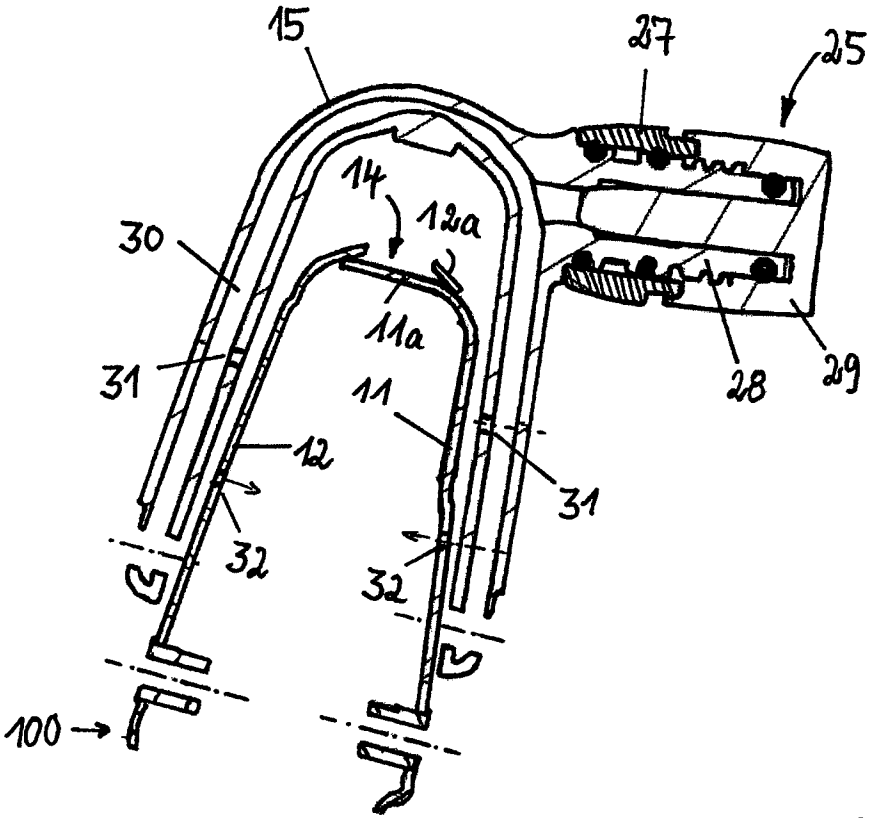
FIG. 3*c* shows a cross-section of a further example of embodiment for arranging a U-shaped element on the protective cover, FIG. 4 show a perspective view of a protective cover with features of the present invention

FIG. 3*a* shows an arrangement of a U-shaped element 15 over a protective cover 100 in a non-engaged position. The U-shaped element is in the form of a U and on one side has a connection piece 28 on which the coupling element 27 is mounted. In the cross-section view the coupling element 27 is in cross-section in the belt area and surrounds the coupling for connecting the pipeline 24 as shown in FIG. 2*a*. Also, an actuator 29 for forming the regulating valve 25 is arranged on the connection piece 28. Via the connection piece 28 and the coupling element 27 a hollow space 30 formed in the U-shaped element 15 can be supplied with the fluid medium and the U-shaped element 15 also has spray nozzles 31 which are in alignment with holes 32 in the wall elements 11 and 12 of the protective cover 100 when the U-shaped element 15 is arranged in its ultimate position on the protective cover 100.

The protective cover 100 is formed by a first wall element 11 and a second wall element 12. The wall elements 11 and 12 are connected to each other in a parallel-spaced arrangement. The first wall element 11 comprises a circumferential section 11*a* and the second wall element 12 comprises a second circumferential section 12*a*, whereby the circumferential sections 11*a* and 12*a* overlap each other in the circumferential area of the protective cover 100. The first circumferential section 11*a* forms the inner-lying section and the second circumferential section 12*a* forms the outer-lying circumferential section, which overlaps the inner-lying first circumferential section 11*a*. The cross-section is in the area of the opening 14 so that this can be seen as an interruption in the outer-lying second circumferential section 12*a*. It is also shown that the inner-lying first circumferential section 11*a* extends under the area of the opening 14 of the outer-lying second circumferential section 12*a*. The project 16 on the U-shaped element 15 can engage in the opening 14 when the U-shaped element 15 is arranged in the final position on the protective cover 100 as shown in FIG. 3*b*.

FIG. 3*b* shows a cross-section of the arrangement of the U-shaped element 15 on the protective cover 100, whereby it can be seen that the projection 16 on the U-shaped element 15 is engaging in the opening 14 in the second, outer-lying circumferential section 12*a* of the second wall element 12. Also seen is the protective effect of the first circumferential section 11*a*, which extends below the opening 14 in the tool direction, so that particles, sparks and suchlike present in the tool space 13 cannot emerge from the opening 14 and, more particularly, cannot come to rest between the protective cover 100 and the U-shaped element 15.

The arrangement of the U-shaped element 15 on the protective cover 100 is shown, by way of example, with screw elements 20 which are screwed into threaded holes 19. The threaded holes 19 are formed by insert sleeves 33 which are pressed into the wall elements 11 and 12.

In particular it can be seen that the holes 32 in the wall elements 11 and 12 are in alignment with the spray nozzles 31 in the U-shaped element 15. The fluid medium, more particularly water, can thus be sprayed into the tool space 13 from the connection piece 28 via the hollow space 30.

Figure 3C:
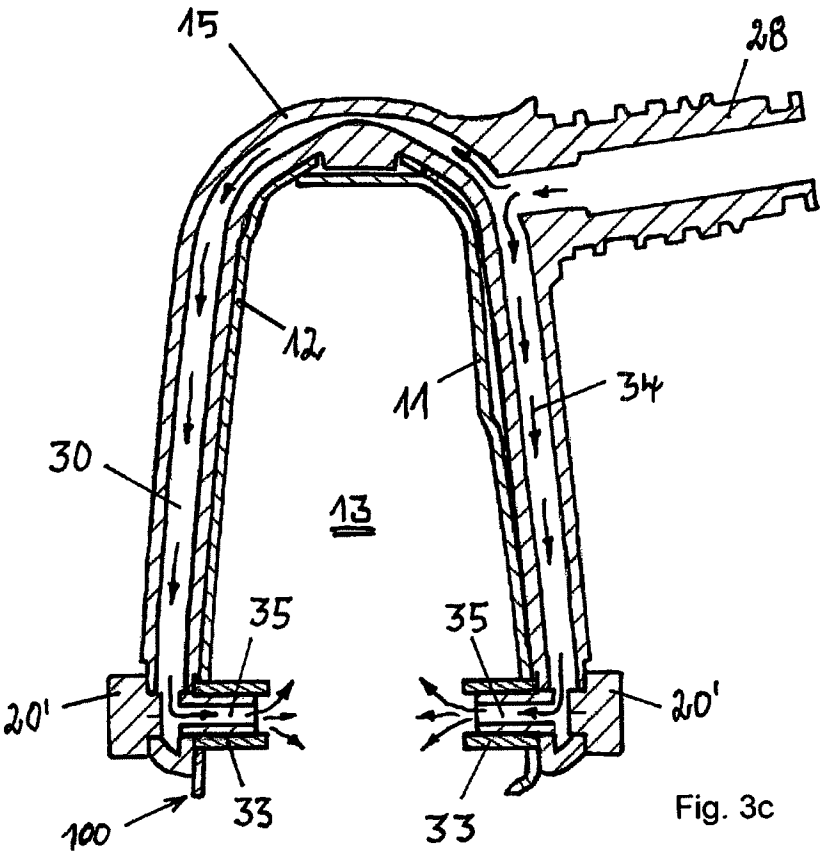

FIG. 3*c* shows a further example of embodiment for arranging a U-shaped element 15 on the protective cover 100. The protective cover 100 has insert sleeves 33 pressed into the wall elements 11 and 12 into which nozzle screws 20' are screwed. The nozzle screws 20' are designed with spray channels 35 through which the fluid medium can reach the tool space 13, whereby the nozzle screws 20' also fulfil the function of screwing the U-shaped element 15 to the protective cover 100. Starting from the connection piece 28 this produces a fluid path 34 into the hollow space 30, whereby the medium can finally enter the relevant spray channel 35 of the nozzle screws 20' from the hollow space 30 in order to enter the tool space 13.

Figure 4:
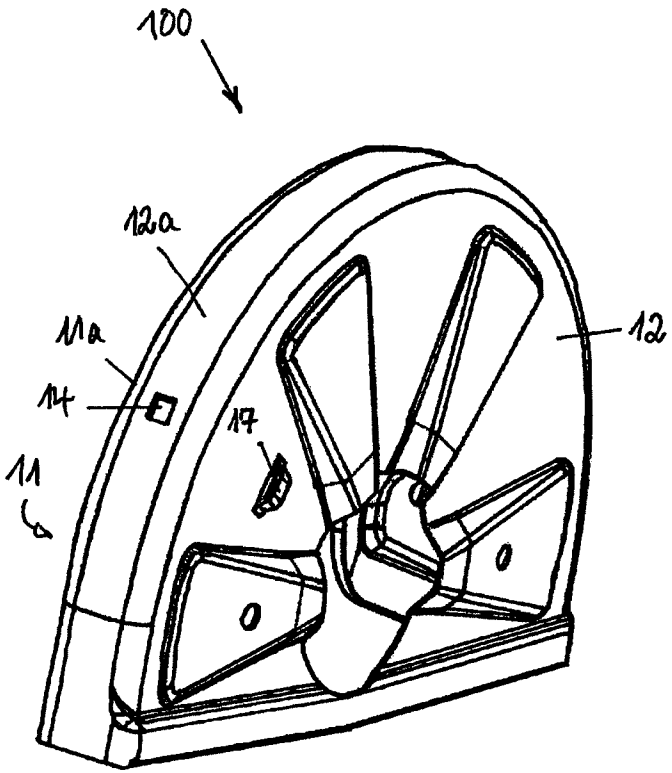

In FIG. 4 a further example embodiment of the protective cover 100 serving to accommodate a functional element 15. In the circumferential wall of the protective cover 100 there is an opening 14 and the protective cover 100 can be produced in the same way as already described in FIGS. 3*a* and 3*b*. In this way the protective cover 100 can comprise two wall elements 11 and 12 which are connected to each other in a parallel-spaced arrangement. In the circumferential area the wall elements 11 and 12 have circumferential sections 11*a* and 12*a* which overlap each other. In the outer-lying circumferential section 12*a* there is an opening 14 into which a projection 16 on the functional element 15 can engage in the already described manner. For further fastening of the functional element 15 the wall elements 11 and 12 have projecting lugs 17 into which the functional element 15 can engage. The engaging of the functional element 15 into the lugs take place at the same time as the engaging of the projection 16 in the opening 14, as shown in more detail in following FIG. 5.

Figure 5:
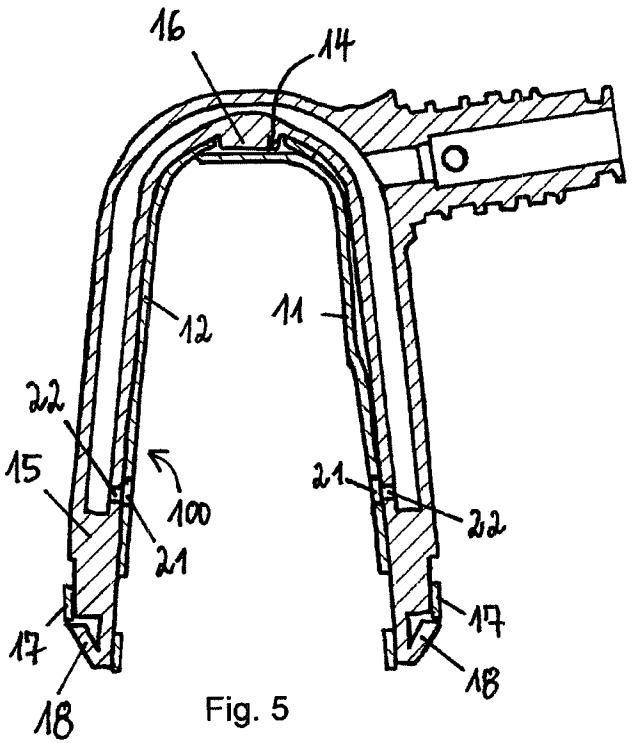
FIG. 5 shows a cross-section of the protective cover with a U-shaped element arranged on it, the U-shaped element having locking hooks which are engaged in lugs formed on the wall elements of the protective cover.

FIG. 5 shows a cross-section of a U-shaped element 15 arranged on a protective cover 100, whereby the U-shaped element 15 is fastened to the protective cover 100 by a catch system. The U-shaped element 15 is in form of a U and has two shanks which surround the protective cover 10. Arranged at the ends of the shanks are locking hooks 18 which engage is the projecting lugs 17 in the wall elements 11 and 12 of the protective cover 100. With simultaneous engaging of the projection 16 on the U-shaped element 15 in the opening 14 of the protective cover 100 a mechanically highly resilient connection is produced between the U-shaped element 15 and the protective cover 100, and through the engaging of the locking hooks 18 in the lugs 17 the U-shaped element 15 is arranged on the protective cover 100 free of connection means. For removing the U-shaped element 15 the locking hooks 18 only have to be bent back in order to be removed from the projecting lugs 17 of the wall elements 11 and 12.

The invention is not restricted to the above preferred examples of embodiment. Rather, a number of variations are conceivable which make use of the described solutions, even in fundamentally different designs. All features and/or advantages, including structural details or spatial arrangements set out in the claims, the description or the drawings can be essential to the invention individually or in the most varied of combinations. More particularly, the catch system with the locking hooks 18 and projecting lugs 17 can be used in order to align the spray nozzles 22 in the U-shaped element 15 with the holes 21 in then wall elements 11 and 12 in accordance with the illustrations in FIGS. 3*a* and 3*b* so as to be able to spray the fluid medium into the tool space 13.

LIST OF REFERENCES

100 Protective cover
1 Handheld power tool
5 Supply device
10 Tool
11 First wall element
11*a* First circumferential section
12 Second wall element
12*a* Second circumferential section
13 Tool space
14 Opening
15 Functional element, U-shaped element
16 Projection
17 Projecting lug
18 Locking hook
19 Threaded hole
20 Screw element
20' Nozzle screw
21 Hole
22 Spray nozzle
23 Hole
24 Pipeline
25 Regulating valve
26 Combustion motor
27 Coupling element
28 Connection piece
29 Actuator element
30 Hollow space
31 Spray nozzle
32 Hole
33 Insert sleeve
34 Fluid path
35 Spray channel

What is claimed is:

1. A protective cover for a handheld power tool having a tool that is at least partially surrounded by the protective cover, the protective cover comprising:

a first wall element; and a second wall element, wherein the first wall element and the second wall element are connected to each other in a parallel-spaced arrangement to define a tool space, the first wall element has a first circumferential section and the second wall element has a second circumferential section, the first and second circumferential sections overlap each other to define a circumferential wall of the protective cover that connects the first and second wall elements, the first circumferential section is an inner lying section of the circumferential wall, the second circumferential section is an outer lying section of the circumferential wall provided with at least one opening, and the inner lying section extends underneath the at least one opening, and the protective cover is configured to accommodate at least one functional element, and the at least one functional element has a projection that is insertable into the at least one opening of the outer lying section of the circumferential wall.

2. The protective cover in accordance with claim 1, wherein the at least one functional element has one of a hand grip for operating the protective cover, a U-shaped element of a supply device for supplying a fluid medium to the tool, or both the hand grip and the U-shaped element.

3. The protective cover in accordance with claim 1, wherein the first and second wall elements are made of a bendable and punchable flat metal, and at least one of the first and second wall elements has a projecting lug into which the at least one functional element can be locked into place by a locking hook on the at least one functional element.

4. The protective cover in accordance with claim 1, wherein the first and second wall elements have at least one threaded hole into which a screw element can be screwed.

5. The protective cover in accordance with claim 2, wherein the first and second wall elements have at least one hole into or through which a spray nozzle arranged on the U-shaped element extends or which aligns with the spray nozzle on the U-shaped element in order to feed the fluid medium through the hole to the tool.

6. The protective cover in accordance with claim 1, wherein the first wall element and the second wall element are connected to each other by a connection element.

7. The protective cover in accordance with claim 1, wherein the at least one opening defines a cut-out of a predetermined shape, and the projection of the at least one functional element matches the shape of the at least one opening.

8. The protective cover in accordance with claim 1, wherein an edge of the at least one opening in the outer lying section of the second circumferential section is radially bend out upwards in order to increase a height of the edge over the inner lying circumferential section of the first circumferential section.

9. The protective cover in accordance with claim 1, wherein the protective cover is configured so that the at least one functional element can be held in a self-retaining manner on the protective cover free of fasteners.

10. A handheld power tool comprising:

a tool; and a protective cover, which at least partially surrounds the tool, the protective cover comprising:

a first wall element; and a second wall element, wherein the first wall element and the second wall element are connected to each other in a parallel-spaced arrangement to define a tool space, the first wall element has a first circumferential section and the second wall element has a second circumferential section, the first and second circumferential sections overlap each other to define a circumferential wall of the protective cover that connects the first and second wall elements, the first circumferential section is an inner lying section of the circumferential wall, the second circumferential section is an outer lying section of the circumferential wall provided with at least one opening, and the inner lying section extends underneath the at least one opening, and the protective cover is configured to accommodate at least one functional element, and the at least one functional element has a projection that is insertable into the at least one opening of the outer lying section of the circumferential wall.

* * * * *